US008911310B2

(12) United States Patent
Lee

(10) Patent No.: US 8,911,310 B2
(45) **Date of Patent: *Dec. 16, 2014**

(54) ARROWHEAD HAVING EXPANDING BLADES CONTROLLED BY GEAR MECHANISM

(71) Applicant: Young Ki Lee, Busan (KR)

(72) Inventor: Young Ki Lee, Busan (KR)

( * ) Notice: Subject to any disclaimer, the term of this patent is extended or adjusted under 35 U.S.C. 154(b) by 23 days.

This patent is subject to a terminal disclaimer.

(21) Appl. No.: 13/900,931

(22) Filed: May 23, 2013

(65) Prior Publication Data

US 2013/0316861 A1 Nov. 28, 2013

Related U.S. Application Data

(63) Continuation-in-part of application No. 13/479,073, filed on May 23, 2012, now Pat. No. 8,529,385.

(51) Int. Cl.
*F42B 6/08* (2006.01)

(52) U.S. Cl.
CPC ..... *F42B 6/08* (2013.01)
USPC ..... 473/583

(58) Field of Classification Search
CPC ..... F42B 6/08
USPC ..... 473/583, 584
See application file for complete search history.

(56) References Cited

U.S. PATENT DOCUMENTS

| | | | | |
|---|---|---|---|---|
| 4,973,060 | A | 11/1990 | Herzing | |
| 5,066,021 | A | 11/1991 | DeLucia | |
| 5,082,292 | A | 1/1992 | Puckett et al. | |
| 6,200,237 | B1 | 3/2001 | Barrie | |
| 6,258,000 | B1 | 7/2001 | Liechty, II | |
| 6,287,223 | B1 | 9/2001 | Liechty, II | |
| 6,669,586 | B2 | 12/2003 | Barrie et al. | |
| 8,062,155 | B2 | 11/2011 | Butcher | |
| 8,118,694 | B1 * | 2/2012 | Oliveira | 473/583 |

* cited by examiner

*Primary Examiner* — John Ricci
(74) *Attorney, Agent, or Firm* — Brich, Stewart, Kolasch & Birch, LLP

(57) ABSTRACT

Disclosed is an arrowhead in which a plurality of expandable blades can be quickly and reliably retracted or expanded without using an additional means to bundle the expanding blades, thereby enhancing the penetrating capability or killing capability of an arrow. Particularly, a portion of a shaft forming the arrowhead is provided with a rack gear portion installed thereon and a lower end of each of the expanding blades is provided with a pinion gear portion, such that the rack gear portion and the pinion gear portion engage with each other and such a rack-pinion action controls the operation of retracting or expanding the expanding blades.

10 Claims, 8 Drawing Sheets

ARROWHEAD HAVING EXPANDING BLADES CONTROLLED BY GEAR MECHANISM

This application is a Continuation-In-Part of copending application Ser. No. 13/479,073 filed on May 23, 2012, the entire contents of which are hereby incorporated by reference and for which priority is claimed under 35 U.S.C. §120.

BACKGROUND OF THE INVENTION

1. Field of the Invention

The present invention relates, in general, to an arrowhead having expanding blades capable of being retracted or expanded by a gear mechanism, and, more particularly, to an arrowhead in which a rack gear formed on a shaft is engaged with pinion gears of expanding blades coupled to a main body, and thus a relative movement between the main body and the rack gear causes the retraction or expansion of the expanding blades.

2. Description of the Related Art

Generally, an arrow is composed of a hollow arrow shaft, an arrowhead attached to a leading end of the arrow shaft, the nock of an arrow using which the arrow is fit in the string, and feathering for securing the flight stability of an arrow.

The arrowhead serves to pass through a target, so it should have excellent wear resistance and strength and it should have a structure enabling its flight to be stable, because upon hitting the target, the accumulated energy of an arrow is collected upon the arrowhead.

Generally, an arrowhead has a sharpened tip to improve penetration, but such a sharpened arrowhead is not practical for certain types of hunting. This is because it is difficult for the sharpened arrowhead to kill large game and thus gain control over the same. Thus, for this reason, a broad type arrowhead which has two to four sharp blades on its edge to induce profuse bleeding and the death of game may be used.

There is also disclosed a variety of arrowheads in which the blades are normally retracted inside the arrowhead and expand upon hitting a target because the blades of the broad type arrowhead affect the flight stability of an arrow.

Such blades having an expandable structure are referred to as expanding blades. A variety of conventional examples of arrowheads having such expanding blades are disclosed in U.S. Pat. No. 5,082,292 entitled "BROADHEAD WITH DEPLOYABLE CUTTING BLADES," U.S. Pat. No. 5,066,021 entitled "ARROW SYSTEM," U.S. Pat. No. 4,973,060 entitled "ARROHEAD WITH EXPANDABLE BLADES," U.S. Pat. No. 6,669,586 entitled "EXPANDING BROADHEAD," U.S. Pat. No. 6,258,000 entitled "PENETRATION ENHANCING AERODYNAMICALLY FAVORABLE ARROWHEAD," U.S. Pat. No. 6,287,223 entitled "DULLING PREVENTION FOR SHARP CUTTING EDGE OF BLADE-OPENING ARROWHEAD BLADES WHEN IN A CLOSED IN-FLIGHT POSITION," U.S. Pat. No. 8,062,155 entitled "ARROWHEAD HAVING BOTH FIXED AND MECHANICALLY EXPANDABLE BLADES," and U.S. Pat. No. 6,200,237 entitled "SLIDING BODY EXPANDING BROADHEAD," respectively.

All of the patent documents described above disclose an arrowhead having two to four expanding blades, in which, when an arrow hits a target, such as game, a plurality of expanding blades are expanded to enlarge and more deeply penetrate into the wound of the game, thereby enhancing the killing capability of the arrow.

However, such conventional expanding blades have a problem in that, when an arrow is flying after being shot, the expanding blades expand by themselves, thereby degrading the flight stability of the arrow and adversely affecting the hit rate and flight distance of the arrow.

Due to such a problem, in the case of an arrowhead having the conventional expanding blades, the plurality of expanding blades must be typically retracted and grouped together before an arrow is shot, and then be tied by a band or string which can be easily broken or slip off when the arrow hits the target.

In doing so, the expanding blades are maintained in a retracted state during flight of the arrow, but can be expanded by slipping-off of the band or string as soon as the arrow hits and penetrates into the target.

However, in such a manner in which the expanding blades should be retracted and then tied or bundled by the band and the like, there are inconveniences in that the retracted expanding blades must be bundled by the band and the like whenever an arrow is shot, and in turn the band must be always carried when hunting.

Therefore, there is a need to develop an arrowhead in which, during flight of an arrow, retracted expanding blades can be kept un-expanded to ensure the flight stability without using an additional means, and the expanding blades can automatically expand only when the arrow hits and penetrates into a target.

DOCUMENTS OF RELATED ART

U.S. Pat. No. 5,082,292 entitled "BROADHEAD WITH DEPLOYABLE CUTTING BLADES";

U.S. Pat. No. 5,066,021 entitled "ARROW SYSTEM";

U.S. Pat. No. 4,973,060 entitled "ARROHEAD WITH EXPANDABLE BLADES";

U.S. Pat. No. 6,669,586 entitled "EXPANDING BROADHEAD";

U.S. Pat. No. 6,258,000 entitled "PENETRATION ENHANCING AERODYNAMICALLY FAVORABLE ARROWHEAD";

U.S. Pat. No. 6,287,223 entitled "DULLING PREVENTION FOR SHARP CUTTING EDGE OF BLADE-OPENING ARROWHEAD BLADES WHEN IN A CLOSED IN-FLIGHT POSITION";

U.S. Pat. No. 8,062,155 entitled "ARROWHEAD HAVING BOTH FIXED AND MECHANICALLY EXPANDABLE BLADES"; and U.S. Pat. No. 6,200,237 entitled "SLIDING BODY EXPANDING BROADHEAD."

SUMMARY OF THE INVENTION

Accordingly, an object of the present invention is intended to provide an arrowhead having expanding blades capable of being retracted or expanded as required, in which the expanding blades can be maintained in a retracted state without using an additional means to bundle up the expanding blades during flight of an arrow, and then can quickly and reliably expand only when the arrow hits a target.

In order to achieve the above object, according to one aspect of the present invention, there is provided an arrowhead having expanding blades controlled by a gear mechanism, including: a penetrating tip including a sharpened leading end and a screw thread formed on an inner peripheral surface thereof; a main body adapted to allow a lower end of the penetrating tip to be inserted therein, the main body including a body portion having a hollow portion therein and opened on upper and lower end sides thereof, a plurality of expanding blade coupling pieces formed on an outer surface of the body portion, and a plurality of expanding blade receiving grooves respectively formed on a surface of each of the plurality of expanding blade coupling pieces; a plurality of expanding blades respectively hingedly and rotatably coupled to each of the expanding blade coupling pieces, the plurality of expanding blades each including a blade formed on one side end thereof and a pinion gear portion formed on a lower end thereof; a shaft including a body portion, a front-end threaded portion formed on an upper end of the body portion to be coupled to the screw thread of the penetrating tip, a rear-end threaded portion formed on a lower end of the body portion to be coupled to an arrow shaft, a rack gear portion provided on an outer peripheral surface of the body portion to engage with the pinion gear portion, and a stopper formed to protrude from the outer peripheral surface below the rack gear portion; and a spring mounted on the shaft; wherein a relative movement between the rack gear portion and the pinion gear portion causes the retraction or expansion of the expanding blades.

In this case, the rack gear portion may be provided slidably on the body portion of the shaft.

Also, the spring may be inserted onto the shaft and positioned upper portion of the rack gear portion.

Furthermore, the rack gear portion is installed fixedly on the body portion of the shaft.

Also, the spring may be inserted onto the shaft such that a lower end of the spring is supported by the stopper, and an upper end of the spring is fixedly coupled on an inner diameter surface of the main body.

Preferably, the penetrating tip may include a tip portion provided with a tip edge and a cylindrical body portion having the screw thread formed on an inner peripheral surface thereof, and a shoulder may be defined between the tip portion and the cylindrical body portion.

Also, the main body may be opened on upper and lower ends thereof to communicate with the hollow portion therein, and an outer diameter of the main body is gradually reduced from the lower end to the upper end.

Also, the shape of the pinion gear portion may be overall that of an arc and may include streamline-shaped protrusions and streamline-shaped grooves alternately formed on a lower end thereof.

Furthermore, each of the expanding blades may include a spur formed on a front end thereof to be folded at a predetermined angle relative to the blade.

Additionally, the stopper may be formed to protrude in a circular shape from an outer peripheral surface of the body portion between the rear-end threaded portion and the rack gear portion such that the diameter of the stopper may be larger than the diameter of the body portion.

According to the present invention, the following effects may be obtained.

The plurality of expanding blades provided in the arrowhead is maintained in a retracted state without using an additional means to bundle the expanding blades during flight of an arrow and then expand only when the arrow hits a target, thereby providing excellent flight stability of the arrow and very excellent killing capability against a target.

Particularly, means or mechanisms for retracting or expanding the plurality of expanding blades in a timely manner have a simple structure, thereby easily assembling or manufacturing the arrowhead and also obtaining the trouble-free arrowhead.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
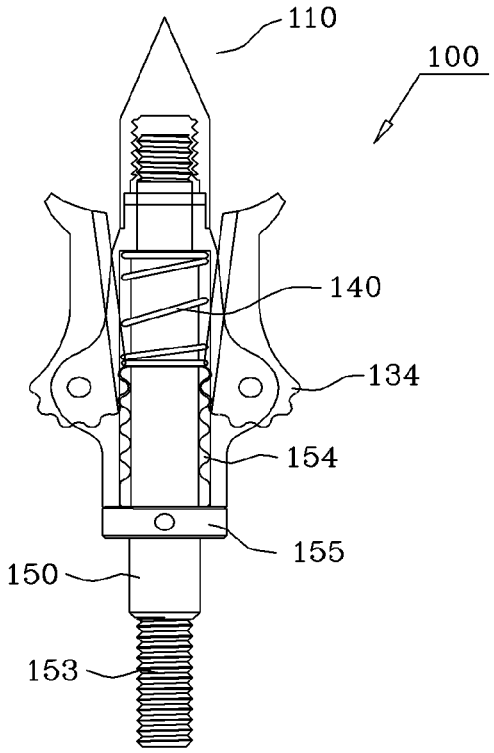
FIG. 1 shows a perspective view of an arrowhead with expanding blades retracted according to the present invention.

Reference will now be made in greater detail to the construction and operating principle of the invention, an example of which is illustrated in the accompanying drawings. Wherever possible, the same reference numerals will be used throughout the drawings and the description to refer to the same or like parts.

Figure 2:
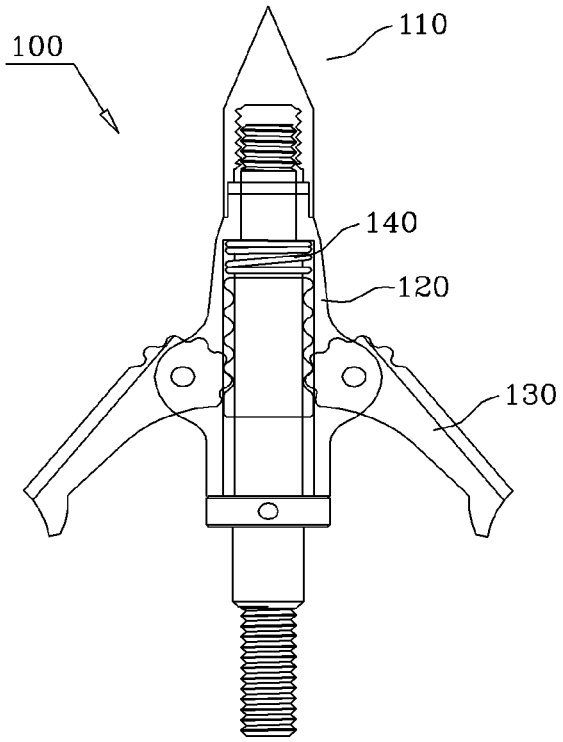
FIG. 2 shows a perspective view of the arrowhead with the expanding blades expanded according to the present invention.
Figure 3:
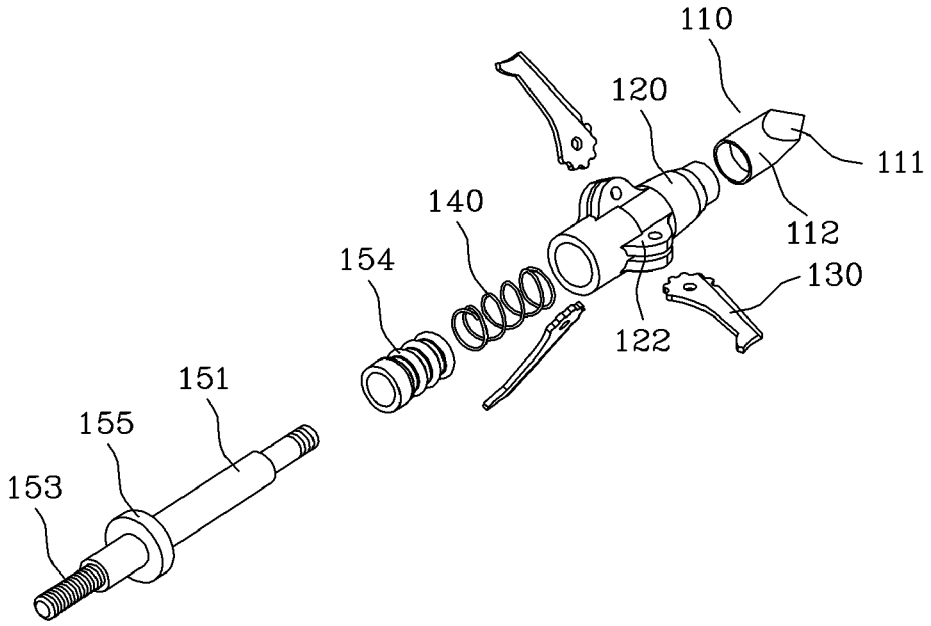
FIG. 3 shows an exploded perspective view of the arrowhead according to the present invention.
Figure 4:
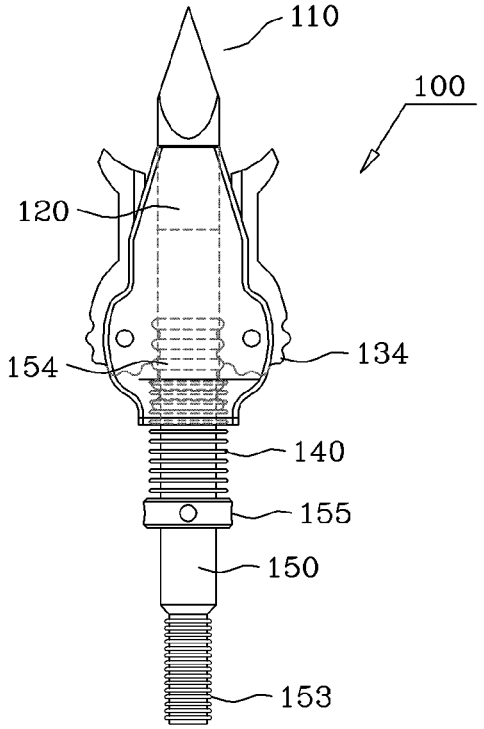
FIG. 4 shows a perspective view of an arrowhead with expanding blades retracted according to another embodiment of the present invention.
Figure 5:
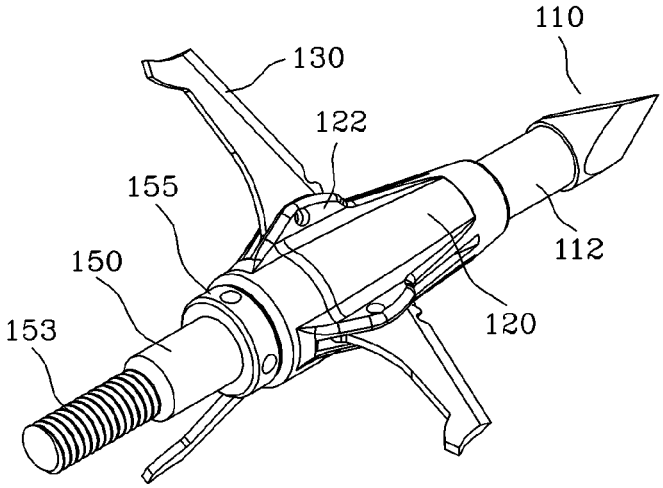
FIG. 5 shows a perspective view of the arrowhead with the expanding blades expanded according to another embodiment of the present invention.
Figure 6:
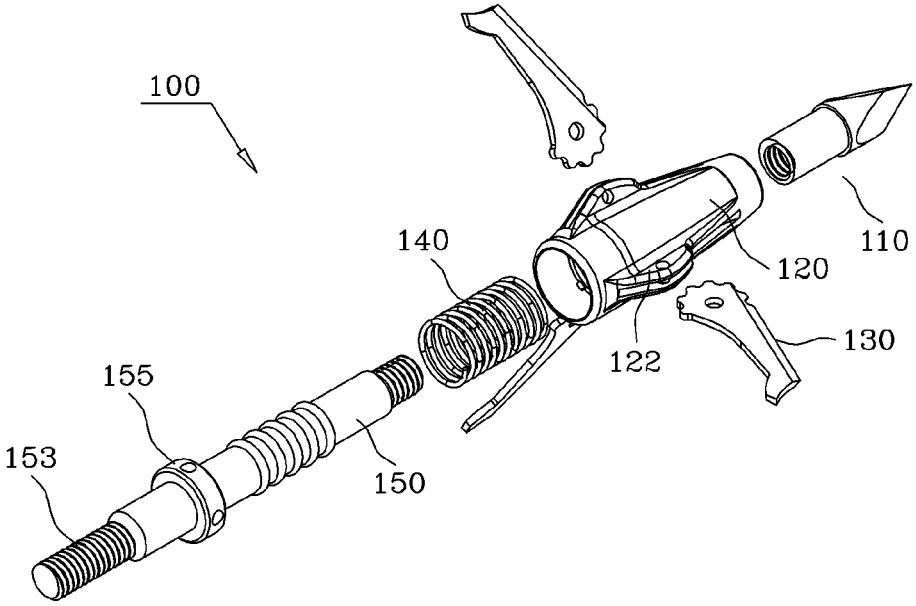
FIG. 6 shows an exploded perspective view of the arrowhead according to another embodiment of the present invention.
Figure 7:
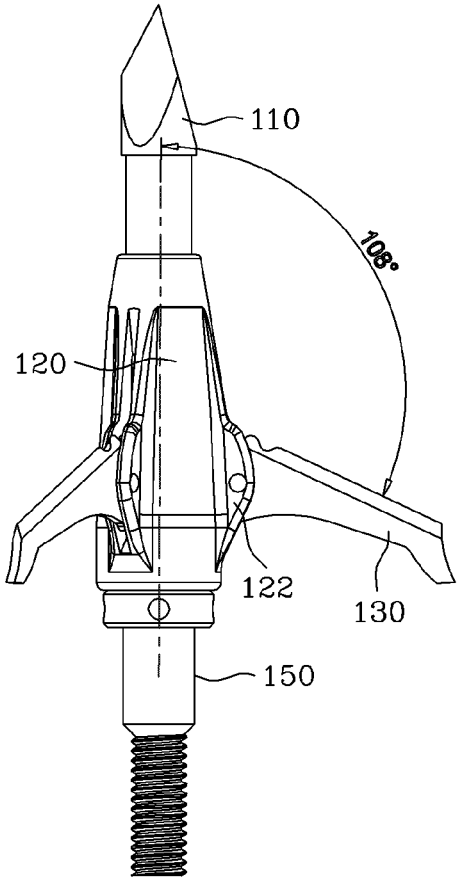
FIG. 7 shows a front view of the arrowhead according to the present invention.
Figure 8:
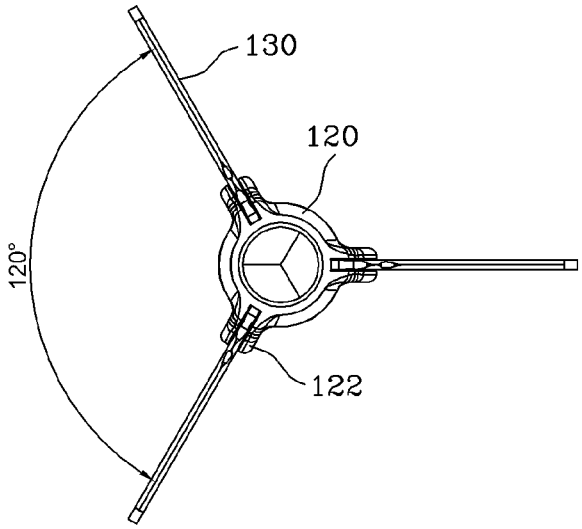
FIG. 8 shows a plan view of the arrowhead of FIG. 7.

FIG. 1 shows a perspective view of an arrowhead with expanding blades retracted according to the present invention, FIG. 2 shows a perspective view of the arrowhead with the expanding blades expanded according to the present invention, FIG. 3 shows an exploded perspective view of the arrowhead according to the present invention, FIG. 4 shows a front view of the arrowhead according to the present invention.

An arrowhead 100 according to the present invention generally includes a penetrating tip 110 for penetrating into a target, a main body 120 having a hollow portion therein and adapted to allow a shaft 150 as described below to be inserted therein, a plurality of expanding blades 130 rotatably mounted on the main body 120, a spring 140, and the shaft 150 extending through the main body 120 and threadably coupled to the penetrating tip 110.

FIG. 1 shows a state of retraction of the plurality of expanding blades 130, and, for convenience, illustrates in a transparent manner the main body 120 to aid the understanding of an inside structure thereof.

When an arrow hits a target, the penetrating tip 110 is adapted to penetrate into the skin and flesh of game as the target and has a sharpened leading end.

The penetrating tip 110 has an inner peripheral surface provided with a screw thread 112*b* to be coupled to a front-end threaded portion 152 of the shaft 150 as described below.

The penetrating tip 110 may have a tip portion 111 at its front end and a body portion 112 at its rear end.

Figure 9A:
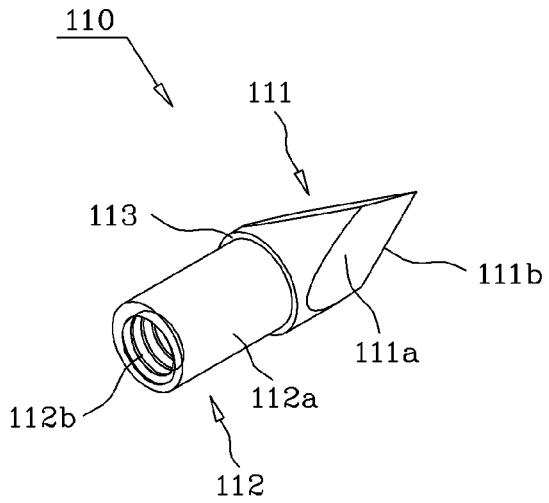
FIGS. 9A and 9B show a perspective view and a front sectional view of a penetrating tip according to the present invention.

As shown in FIG. 9A, the tip portion 111 has flat tip surfaces 111*a* and tip edges 111*b* formed by sharpened corners.

A cylindrical tip body 112*a* of the body portion 112 has an inner peripheral surface provided with a screw thread 112*b* to be coupled to a front-end threaded portion 152 of the shaft 150 as described below.

Figure 9B:
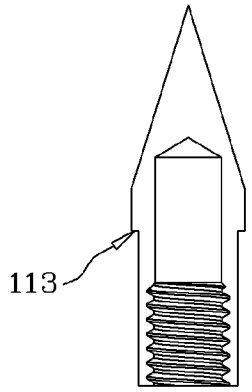

And, as shown in FIGS. 9A and 9B, a boundary portion between the tip portion 111 and the cylindrical body portion 112 may be provided with a shoulder 113.

Figure 10A:
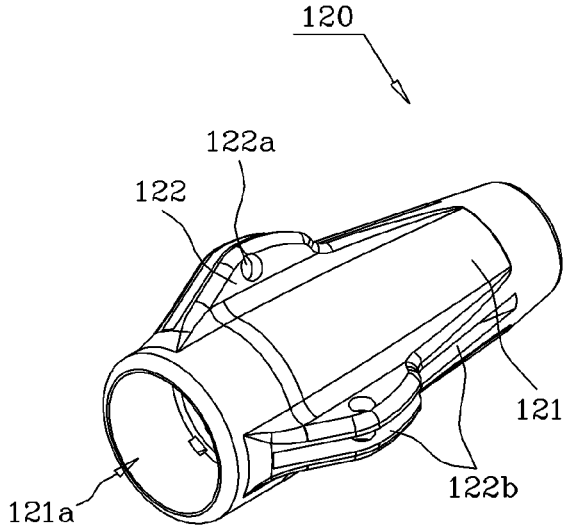
FIGS. 10A and 10B show a perspective view, and a front view, a plan view and a bottom view of a main body according to the present invention.
Figure 10B:
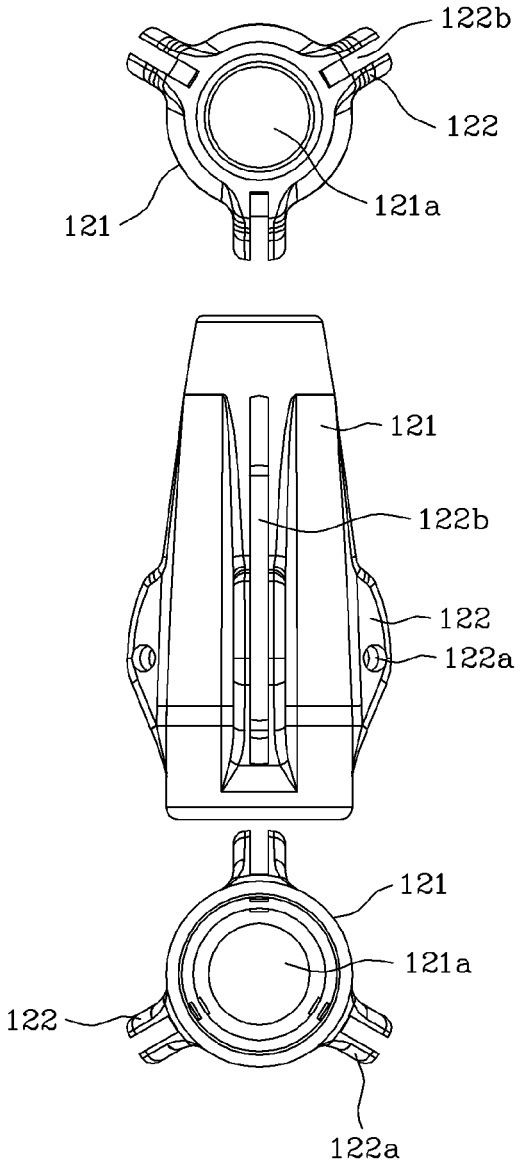

FIG. 10A shows a perspective view, and FIG. 10B shows a front view, a plan view and a bottom view of the main body according to the present invention. The main body 120 has a hollow portion 121*a* vertically extending through and with openings at upper and lower end sides of a body portion 121, and an outer surface of the body portion 121 is provided with a plurality of expanding blade coupling pieces 122 protruding from the outer surface.

The body portion 121 preferably has a truncated cone shape in which its outer diameter is generally gradually reduced from a lower end to an upper end, but it is not necessary to be limited to such a configuration.

Each of the expanding blade coupling pieces 122 has a hinge shaft coupling hole 122*a* extending through side surfaces thereof. And each of the expanding blade coupling pieces 122 may have an expanding blade receiving groove 122*b* elongatedly formed in a longitudinal direction of the main body 120 as shown in FIG. 10B.

The whole or a portion of the expanding blade receiving groove 122*b* is formed to communicate with the hollow portion 121*a* inside the body portion 121, thereby allowing a pinion gear portion 134 of the expanding blade 130 as described below to engage with a rack gear portion 154 of the shaft 150 as described below.

Figure 11:
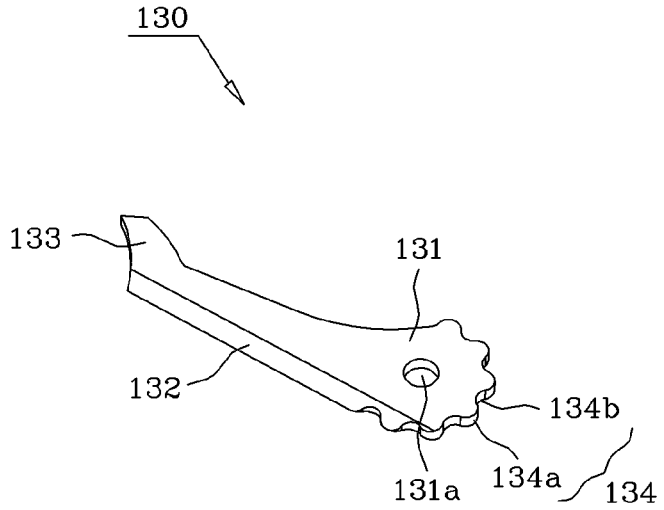
FIG. 11 shows a perspective view of an expanding blade according to the present invention.
Figure 12:
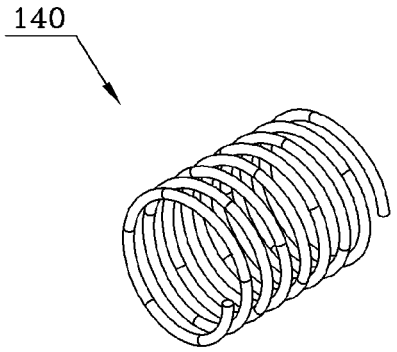
FIG. 12 shows a perspective view of a spring according to the present invention.
Figure 13A:
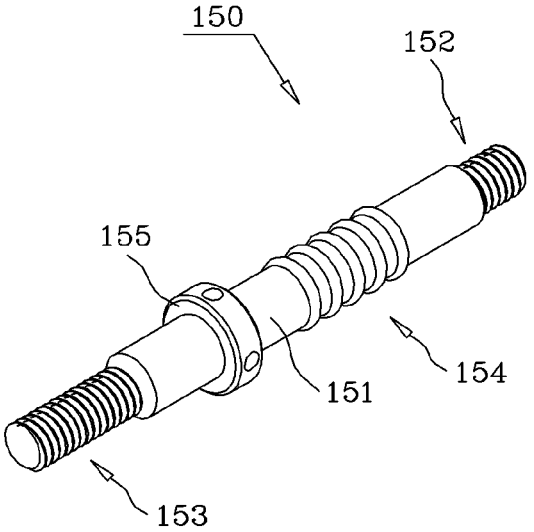
FIGS. 13A and 13B show a perspective view and a front view of a shaft according to the present invention.
Figure 13B:
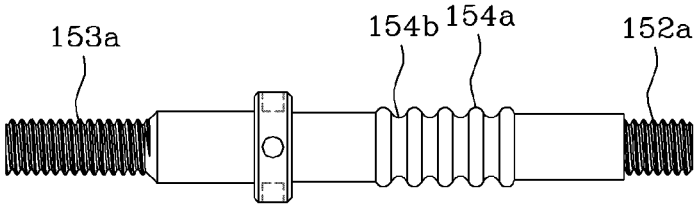

FIG. 11 shows a perspective view of an expanding blade according to the present invention. As shown, the expanding blade 130 of the invention generally includes a body portion 131 having a blade 132 formed on its one side end, a spur 133 formed in a folded or bended shape on an upper end of the body portion 131, and the pinion gear portion 134 formed on a lower end of the body portion 131. The body portion 131 is also provided with a hinge shaft coupling hole 131*a* extending through a flat surface thereof.

The pinion gear portion 134 has a plurality of streamline-shaped protrusions 134*a* and a plurality of streamline-shaped grooves 134*b* alternately formed on a generally semicircular-shaped arc end thereof, and engages with the rack gear portion 154 of the shaft 150 as described below.

It is not necessary for the shape of gear teeth in the pinion gear portion 134 to be limited to the streamline-shaped curved surface, and this shape may be substituted for by any other shape as required. Accordingly, it should be appreciated by those skilled in the art that such a configuration may also fall within the spirit and scope of the invention.

The shaft 150 of the invention is coupled to the penetrating tip 110 at its upper end and to an arrow shaft (not shown) at its lower end. The shaft 150 generally includes a cylindrical body portion 151, the front-end threaded portion 152 formed on a front end of the body portion 151, a rear-end threaded portion 153 formed on a rear end of the body portion 151, a stopper 155 protruding from an outer diameter surface of the body portion 151, and the rack gear portion 154 provided on an outer peripheral surface of the body portion 154 located above the stopper 155.

The front-end threaded portion 152 is coupled to the screw thread 112*b* formed on the inner peripheral surface of the penetrating tip 110, and the rear-end threaded portion 153 is threadably coupled and fixed to the front end of the arrow shaft (not shown) in which the arrowhead 100 is inserted.

On the rack gear portion 154 provided on the outer peripheral surface of the body portion 151 there are disposed in an alternating fashion a plurality of streamline-shaped protrusions 154*a* and a plurality of streamline-shaped grooves 154*b*. Reference numeral 151*a*, which is indicated in the drawings but not described in detail herein, designates a groove with a predetermined length formed on an outer surface of an upper end of the body portion 151.

Similar to the pinion gear portion 134 of the expanding blade 130 as described above, is not necessary for the shape of gear teeth constituting the rack gear portion 154 to be limited to such a streamline shape, and this shape may be substituted for by other shapes as required.

As shown in FIGS. 1 to 3, the rack gear portion 154 may be installed slidably on the outer surface of the body portion 151. And in this case, the spring 140 is positioned between the penetrating tip 110 and the rack gear portion 154, and the expanding blades 130 are maintained in a retracted state by the support of the spring 140 during flight of an arrow. The appearance of the spring 140 is shown in FIG. 9.

In this case, when the expanding blades 130 are expanded, the rack gear portion 154 engaged with the pinion gear portion 134 slides backward. (See FIGS. 1 and 2).

Another embodiment of the rack gear portion 154 is shown in FIGS. 4, 5, 6, 13A and 13B. In this embodiment, the rack gear portion 154 may be installed fixedly on the outer surface of the body portion 151 of the shaft 150. And in this case, an upper end of the spring 140 is fixed on an inner diameter portion of the main body 120, or is caught and supported on an inner diameter surface of the main body 120.

In this case, when the expanding blades 130 are expanded, the main body 120 slides backward by the operation of the pinion gear portion 134 and the rack gear portion 154. (See FIGS. 4 and 5)

The stopper 155 is formed on an outer surface of the body portion 151 between the rear-end threaded portion 153 and the rack gear portion 154 protrudes and has a diameter larger than the diameter of the body portion 151.

The arrowhead 100 according to the present invention constituted of the components as described above is in a retracted state wherein the plurality of expanding blades 130 are retracted as shown in FIG. 1, before the arrow is shot, which changes to an expanded state after the plurality of expanding blades 130 have rotated and expanded downwards as shown in FIG. 2, when the arrow has been shot and hit a target.

In the retracted state as shown in FIG. 1, the spring 140 is left in a compressed state, and the pinion gear portion 134 of each of the expanding blades 130 is engaged with an upper end of the rack gear portion 154 of the shaft 150.

Then, when the arrow has been shot and hits the target, the penetrating tip 110 penetrates into the skin and flesh of game which is the target, during which the expanding blades 130 are expanded and the rack gear portion 154 compresses the spring 140 while moving forward relative to the main body 120.

And in case of the embodiment of the rack gear portion 154 installed fixedly on the outer surface of the body portion 151 of the shaft 150, when the arrow has been shot and hits the target, the penetrating tip 110 penetrates into the skin and flesh of game which is the target, during which the shaft 150 compresses the spring 140 against the main body 120 while moving forward relative to the main body 120.

As the shaft 150 moves forward inside the main body 120, the pinion gear portion 134 of each of the expanding blades 130 engaged with the upper end of the rack gear portion 154 is expanded by being rotated from up to down.

Namely, the rack gear portion 154 moves forward to rotate the pinion gear portion 134, and as a result, the expanding blades 130 are rotated about hinge shafts (not shown).

According to the arrowhead of the present invention having the structure described above, the expanding blades 130 are always maintained in a state of engaging with the rack gear portion 154 by the support of the spring. Therefore, the expanding blades 130 are stably maintained in the retracted state while the arrow is flying when no impact has been applied thereon, but on the other hand, the expanding blades 130 quickly and efficiently expand when they hit the target.

Therefore, an additional means for preventing the unexpected expansion of the expanding blades 130 during flight of the arrow is not required, and a hitting effect against the target is reliable such that ascendancy over the game can be quickly and efficiently gained in a short time.

In the embodiment shown, three expanding blades 130 are installed on the outer surface of the main body 120 at intervals of 120 degrees in a circumferential direction. However, it is not necessary to limit the configuration to that shown, and the number of the expanding blades 130 may be two or four or more as required.

In the above embodiment, an up-and-down rotation angle between the retracted state and the expanded state of the expanding blades 130 is preferably, but not limited to, between roughly 100 degrees to 120 degrees.

As set forth above, the present arrowhead has a plurality of expanding blades to more efficiently and reliably hit game which is the target, in which an operation of retracting or expanding the expanding blades can be reliably performed. Further the present arrowhead has a simple structure and excellent durability.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An arrowhead having expanding blades controlled by a gear mechanism, comprising:

a penetrating tip including a sharpened leading end and a screw thread formed on an inner peripheral surface thereof;

a main body adapted to allow a lower end of the penetrating tip to be inserted therein, the main body including a body portion having a hollow portion therein and openings on upper and lower end sides thereof, a plurality of expanding blade coupling pieces formed on an outer surface of the body portion, and a plurality of expanding blade receiving grooves respectively formed on a surface of each of the plurality of expanding blade coupling pieces;

a plurality of expanding blades respectively hingedly and rotatably coupled to each of the expanding blade coupling pieces, the plurality of expanding blades each including a blade formed on one side end thereof and a pinion gear portion formed on a lower end thereof;

a shaft including a body portion, a front-end threaded portion formed on an upper end of the body portion to be coupled to the screw thread of the penetrating tip, a rear-end threaded portion formed on a lower end of the body portion to be coupled to an arrow shaft, a rack gear portion provided on an outer peripheral surface of the body portion to be engaged with the pinion gear portion, and a stopper formed to protrude from the outer peripheral surface below the rack gear portion; and a spring mounted on the shaft;

wherein a relative movement between the rack gear portion and the pinion gear portion causes a retraction or expansion of the expanding blades.

2. The arrowhead according to claim 1, wherein the rack gear portion is installed slidably on the body portion of the shaft.

3. The arrowhead according to claim 2, wherein the spring is inserted onto the shaft and positioned upper portion of the rack gear portion.

4. The arrowhead according to claim 1, wherein the rack gear portion is installed fixedly on the body portion of the shaft.

5. The arrowhead according to claim 4, wherein the spring is inserted onto the shaft such that a lower end of the spring is supported by the stopper, and an upper end of the spring is fixedly coupled on an inner diameter surface of the main body.

6. The arrowhead according to claim 1, wherein the penetrating tip includes a tip portion provided with a tip edge and a cylindrical body portion having the screw thread formed on an inner peripheral surface thereof, and a shoulder defined between the tip portion and the cylindrical body portion.

7. The arrowhead according to claim 1, wherein the main body is open on upper and lower ends thereof to communicate with the hollow portion therein, and an outer diameter of the main body is gradually reduced from the lower end to the upper end.

8. The arrowhead according to claim 1, wherein the pinion gear portion has an overall arc shape and includes streamline-shaped protrusions and streamline-shaped grooves alternately formed on a lower end thereof.

9. The arrowhead according to claim 8, wherein each of the expanding blades includes a spur formed on a front end thereof to be folded at a predetermined angle relative to the blade.

10. The arrowhead according to claim 1, wherein the stopper is formed to protrude in a circular shape from an outer peripheral surface of the body portion between the rear-end threaded portion and the rack gear portion such that a diameter of the stopper is larger than a diameter of the body portion.

* * * * *